US009386807B2

(12) United States Patent
Dalton

(10) Patent No.: US 9,386,807 B2
(45) Date of Patent: Jul. 12, 2016

(54) BRASSIERE

(76) Inventor: Diane Dalton, Corrales, NM (US)

( * ) Notice: Subject to any disclaimer, the term of this patent is extended or adjusted under 35 U.S.C. 154(b) by 543 days.

(21) Appl. No.: 13/071,907

(22) Filed: Mar. 25, 2011

(65) Prior Publication Data

US 2014/0087626 A1 Mar. 27, 2014

(51) Int. Cl.
*A41C 3/02* (2006.01)
*A41F 15/02* (2006.01)
*A41C 3/12* (2006.01)

(52) U.S. Cl.
CPC ... *A41C 3/12* (2013.01); *A41C 3/02* (2013.01); *A41F 15/02* (2013.01)

(58) Field of Classification Search
CPC ..... A41C 3/00; A41C 3/0021
USPC ..... 450/86; 2/326, 327, 338, 310–312, 336
See application file for complete search history.

(56) References Cited

U.S. PATENT DOCUMENTS

| | | | | | |
|---|---|---|---|---|---|
| 244,776 | A * | 7/1881 | Wales | 24/315 |
| 1,926,078 | A * | 9/1933 | Yonts | 450/86 |
| 2,455,036 | A * | 11/1948 | Boylan | 450/86 |
| 2,709,289 | A * | 5/1955 | Maysilles | 24/200 |
| 3,291,132 | A * | 12/1966 | Puliafico | 450/59 |
| 3,884,244 | A * | 5/1975 | Rowell | 450/52 |
| 5,123,121 | A * | 6/1992 | Broersma | 2/421 |
| 6,023,785 | A * | 2/2000 | Johnson | 2/62 |
| 6,302,761 | B1 * | 10/2001 | Wrenn | 450/86 |
| 6,530,129 | B1 * | 3/2003 | Cheng | 24/200 |

* cited by examiner

*Primary Examiner* — Gloria Hale
(74) *Attorney, Agent, or Firm* — Alberto A. Leon; Aleon Law PC

(57) ABSTRACT

An improvement in a brassiere is described providing a backside having an "X" interconnection with a stabilizing "X" connector which improves the comfort of the wearer.

7 Claims, 2 Drawing Sheets

BRASSIERE

PRIORITY

This application claims is related to U.S. Non-Provisional Application filed on Mar. 10, 2000, Ser. No. 09/523,318 issued into U.S. Pat. No. 6,293,844 on Sep. 25, 2001, which grant claimed priority to U.S. Provisional Application Ser. No. 60/123,956 filed Mar. 12, 1999, as well as a U.S. Provisional Application filed Dec. 31, 2009, number unknown, and a U.S. Provisional Application filed Aug. 9, 2010, Ser. No. 61/371,744. The specifications and drawings of these applications are herein incorporated by reference into the present application.

FIELD OF THE INVENTION

The present invention pertains to brassieres and more specifically to new features that improve comfort of wear.

BACKGROUND OF THE INVENTION

It is desirable to construct a brassiere that does not include a ribcage-encircling band or other features that constrict and bind the wearer causing discomfort.

The following U.S. patents disclose brassieres:

U.S. Pat. No. 5,244,432, entitled Protective and Supportive Brassiere, to Moy Au et al., issued Sep. 14, 1993 discloses a brassiere having shock absorbing cups and a body band, 1982 discloses a brassiere consisting of a wide, circular, elastic rib band, at least one front panel and at least one side panel of material. U.S. Pat. No. 4,220,157, entitled Counterweighted Brassiere for Athletic Use, to Clark et al., issued Sep. 2, 1980 discloses a brassiere that uses suspended weights to lift breast cups. U.S. Pat. No. 3,465,754, entitled Brassiere, to Lockwood et al., issued Sep. 9, 1969, discloses a brassiere that has no direct frontal connection between breast cups. U.S. Pat. No. 3,291,132 entitled Self-Positioning Brassiere, to Puliafico, issued Dec. 13, 1966 discloses a brassiere having a pair of cups, back bands, tape-like members and triangular connecting members for each cup that connect three individual bands. U.S. Pat. No. 3,186,412, entitled Brassiere with Elastic Support Tapes, to Kuland, issued Jun. 1, 1965, discloses a brassiere having a pair of body encircling bands, each connected along an outer perimeter of a breast cup. U.S. Pat. No. 3,112, 50, entitled Garment Having Adjustable Plastic Buckle, to Jonas, issued Dec. 3, 1963, discloses a brassiere having an adjustable plastic buckle positioned at the top of each breast cup. U.S. Pat. No. 3,071,140, entitled Brassiere, to Adler, issued Jan. 1, 1963 discloses a brassiere having two straps, a strap extending from the outer side of each cup, having converging edges; the straps cross at a non-adjustable, fixed position on the wearer's back. U.S. Pat. No. 3,027,898, entitled Self-Adjusting Posture Improvement Attachment for Brassieres, to Williams, issued Apr. 3, 1962 discloses a posture improvement attachment for a brassiere. U.S. Pat. No. 2,753,563, entitled Brassiere to Boylan, issued Nov. 30, 1948 discloses a brassiere having a circular shaped connector for free sliding of two back-crossing straps during wear. U.S. Pat. No. 2,118,378, entitled Suspension Strap, to Graham, issued May 24, 1938 discloses a shoulder strap suspension for garments having a fixed back-crossing connection. U.S. Pat. No. Des. 358,247, entitled Brassiere, to Nishiba, issued May 15, 1995 discloses a brassiere having straps that do not cross on the wearer's backside. U.S. Pat. No. Des. 570,576, entitled Breast Supporter, to Seraceno et al., issued Jun. 10, 2008 depicts a brassiere having very narrow straps that connect to a topmost point of the breast cups and cross on the wearer's backside, with no interconnection, and attaching to side straps extending from the breast cups.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF A PREFERRED EMBODIMENT

Figure 1:
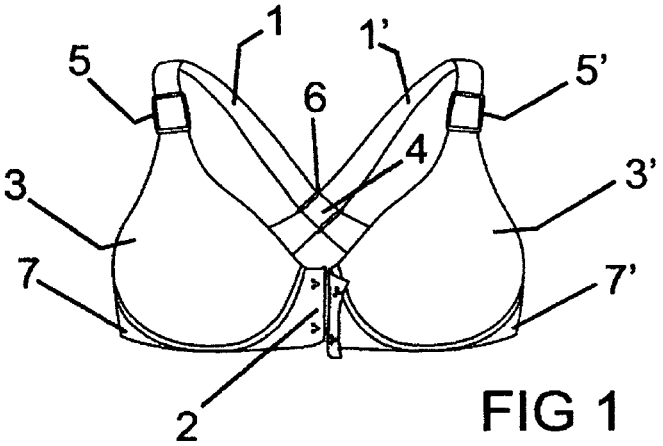
FIG. 1 is a rear view of a preferred embodiment of the brassiere of the present invention worn by a user.

The present invention comprises an improvement for brassieres, as described more fully hereinafter. This invention, may, however, be embodied in different forms and is not limited to the embodiments set forth herein, but the embodiments are set forth only to ensure that those skilled in the art will be enabled in applying the invention.

The terminology as set forth herein is for description of the embodiments only and should not be construed as limiting of the invention as a whole. As used in the description of the invention and the appended claims, the singular forms "a", "an", and "the" are inclusive of their plural forms, unless contraindicated by the context surrounding such.

All technical and scientific terms used herein have the commonly understood meaning of one skilled in the art. All publications, patent applications, patents and other references disclosed herein are incorporated by reference in their entirety.

The brassiere of the present invention comprises at least one strap and at least two breast cups. The present invention optionally comprises at least one connector for connection and/or adjusting straps. In one embodiment, the brassiere comprises an essentially single loop-forming strap configuration comprised of at least one or a plurality of straps or exterior edges of the breast cups of the invention, and two breast cups that are attached to the at least one strap. In this single strap embodiment, the strap crosses itself on the wearer's backside. In a preferred embodiment, the brassiere comprises a connector for connecting a strap to itself or a plurality of straps together at a point on the wearer's backside. In the present invention, the strap or straps substantially form a two-loop figure eight pattern wherein each loop comprises an outer circumference and an inner circumference adjacent to a point where the strap crosses itself (or at least two of a plurality of straps cross one another). The loops are connected with a "X" connector at the intersection of the "X" configuration.

The present invention comprises breast cups where each breast cup comprises an outer perimeter and wherein each breast cup outer perimeter is at some point attached to a strap, or wherein the outer perimeter of said breast cup comprises the continuation of said loop structure. In a preferred embodiment, the brassiere comprises two straps and two breast cups. In one two strap embodiment, each strap starts at or near the top of a breast cup, passes over a shoulder of the wearer and ends at a juncture with the other breast cup and/or strap at or near the lower and outer edge of the same or opposing breast cup.

In alternative embodiments, connectors are used and the strap and/or straps, as described above, are interrupted, thereby forming a bra comprising a plurality of strap portions. It is within the scope of the present invention to alter the aforementioned preferred embodiments with a plurality of interruptions that are bridged with connectors.

According to the present invention, a strap comprises a material comprising, for example, but not limited to, a rectangular and/or circular cross-section. Materials used in construction of brassiere known to one of ordinary skill in the art are suitable for use as straps. Such materials include, for example, elastic and inelastic materials. In a preferred embodiment of the present invention, straps comprise elastic. In an embodiment of the present invention, the brassiere comprises at least one wire following a partial or total circumference of at least one breast cup. Wire is understood to include metal, plastic, fabric, natural and other suitable material. Wire comprising spring coils and/or springlike characteristics is considered within the scope of the invention. The main purpose of the wire, as used herein, is to provide support to a wearer's breast as it sits in a breast cup. In a preferred embodiment of the present invention, wire follows at least a portion of the breast cup circumference while at least one elastic strap follows the remainder of the circumference. It is understood that wire is insertable and/or attachable to a strap and that such a strap optionally comprises elastic and/or inelastic properties. In another preferred embodiment of the present invention, the brassiere comprises a section of strap that passes over the wearer's shoulder comprising a greater width, and/or diameter, than other sections of strap. The purpose of the wider section of strap is to reduce pressure on the wearer's shoulder-the wider section of strap optionally increases or decreases frictional forces with the wearer's skin. In additional embodiments, other sections of strap, for example, below the "X" connector and between that connector and the straps' connection to the breast cups, the strap may be widened for extra support and comfort.

According to the present invention, breast cups comprise material known in the art, preferably formable material. Such material includes, but is not limited to, natural synthetic, and blends of natural and synthetic materials. Materials sold under the trademark LYCRA® (E.I. du Pont de Nemours, Wilmington, Del.) are suitable. However, all materials known in the art for formation of a breast cup portion of a brassiere may be utilized in the present invention and are therefore anticipated.

According to the present invention, the brassiere optionally comprises connectors for connecting and/or adjusting straps. Connectors are placeable at a variety of points. For example, a connector positioned above the breast cup provides for strap adjustment. Connectors are also positionable on the backside of the brassiere, including a point wherein the "X" connection is disposed between the connector and the breast cup. Connectors may be utilized both "above" and "below" the "X" connection. Connectors are useful for bridging interruptions in straps, joining straps and/or for connecting one or more sections of a strap back to the strap itself. In the aforementioned embodiments, the main strap or straps optionally cross, or intersect to form a substantial "X" pattern across the wearer's back. The point of crossing, or connection, is referred to herein as the "X" intersection or connection. The "X" pattern formed by the at least one strap also comprises internal angles that further comprise left side and right side angles and upper and lower angles. In preferred embodiments of the present invention, the left side and right side angles are approximately equal (and are adjustable such that they are not exactly equal, but essentially equal, but suitably adjustable for the body differences of the wearer, and preferably the upper and lower angles are approximately equal. In all of the aforementioned embodiments, the strap, or straps, are interruptible at positions at the "X", above the "X, and below the "X". Interruptions are bridged through use of connectors. Alternatively, the brassiere of the present invention optionally comprises adjusters that do not require interruption or severing of a strap. Such adjusters typically require folding over of a strap or rolling/coiling of a strap to effectuate an adjustment to strap length. Connectors commonly used in the art of brassieres are suitable for achieving connection of straps, adjustment of a strap or straps, and a combination of adjustment and connection.

In a preferred embodiment of the brassiere of the present invention, at least one "X" connector element is positionable at the aforementioned intersection of the "X" pattern. The use of such a connector/adjustor helps to prevent upward creep of the brassiere. In particular, a connector or adjuster that locks the internal angles of the "X" pattern helps to prevent upward creep of the brassiere. In a preferred embodiment, the brassiere of the present invention comprises at least one connector and/or at least one adjuster that locks the internal angles of the "X" pattern. Connectors that, for example, replace the "X" intersection are suitable for use if they also comprise a mechanism for locking the internal angles of the "x" pattern. It is understood that replacement of the "X" intersection with a connector may render a pattern that does not comprise an "X" at the very center; however, an "X" pattern is still present on the wearer's backside formed by the crossing of shoulder straps and side straps. It is understood that in embodiments comprising connectors, connectors optionally connect sides of straps and/or ends of straps. Thus, end-to-end, side-to-side, and/or front-to-back connections are possible and within the scope of the present invention.

EXAMPLES

FIG. 1 is a front view of a preferred embodiment of the brassiere of the present invention. As shown in FIG. 1, the brassiere comprises straps 1, 1', breast cups 3, 3', and "X" intersection 4. Each strap 1, 1' crosses over the wearer's shoulder from front to back, affixing an end of each of straps 1, 1' preferably at an essentially upper point of breast cups 3,3', or running along an outer and/or an inner perimeter of the breast cups to disengage from the perimeter of the breast cup at a point along an upper or side edge of the breast cups to cross above a wearer's shoulder. FIG. 1 also depicts optional front closure element or elements 2 and strap length adjusters 5,5'. These elements are well known in the art, and any front closure elements such as but not limited to hooks and eyes, Velcro®, and snap elements may be utilized. Additionally, strap length adjusters are well known in the art and any such adjusters may be optionally utilized.

Figure 2:
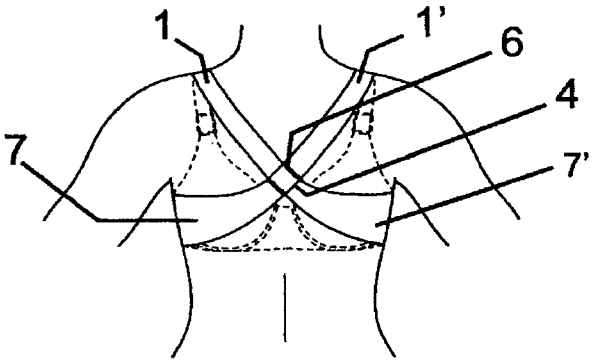
FIG. 2 is a front view of the embodiment of the brassiere of the present invention shown in FIG. 1.

FIG. 2 shows a rear view of the preferred embodiment of FIG. 1 on a wearer. As shown in FIG. 2, straps 1, 1' continue down from the wearer's shoulders to form an "X" intersection configuration 4. The "X" intersection 4 preferably comprises connector 6 for connecting straps 1,1'. This depiction details widened portion 7,7' of straps 1,1' along the straps as they near connection with breast cups 3,3'. This widened portion 7,7' provides a more stable connection to the cups and provides additional comfort to the wearer, particularly in embodiments where straps 1',1', and, more particularly, widened portions 7,7' are padded with extra material as is well known in the art. This embodiment may optionally comprise strap length adjusters 5,5' as shown in FIG. 1.

Figure 3:
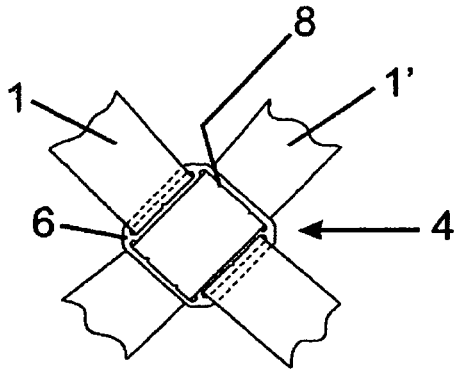
FIG. 3 is an enlarged view of use of a connector element to comprise an "X" intersection of a preferred embodiment of the brassiere of the present invention.
Figure 4:
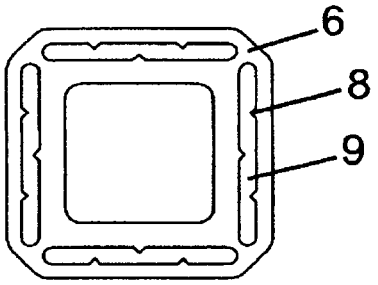
FIG. 4 is an enlarged view of adjuster and connector elements of an additional embodiment of the brassiere of the present invention.
Figure 5:
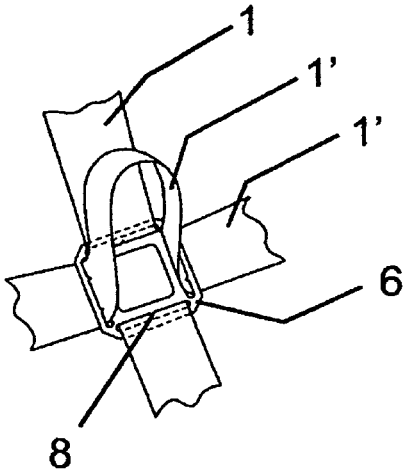
FIG. 5 is an enlarged view of the straps 1, 1' threading through the connector 6.

FIG. 3 depicts "X" intersection 4, wherein connector 6 is preferably an essentially balanced or equilateral unit that fixes the straps into an "X" configuration. Preferably, the straps are adjustable within the connector by the wearer, but the straps are fixed in place while wearing. Connector 6 as depicted in FIG. 4 and disclosed previously in the related provisional application filed Dec. 31, 2009, shows an acceptable, preferred equilaterally balanced connector, having an equilateral distribution of openings 9 for receipt of threaded straps 1,1' disposed to create an "X" angle conformation of the straps. Connector 6 additionally preferably comprises nodes/protrusions 8 within the thread openings 9 to depress the straps and prevent slippage of the strap within the threading. It is preferred, however, that protrusions 8 be sufficiently slight to allow for deliberate adjustment of the straps within the openings. Connector 6 is preferably made of plastic, metal, or other substantially resilient material known in the art for making connectors and adjusters. As shown in FIG. 3 strap 1 is threaded through the connector in one direction and strap 1' is threaded through in the other direction to form the "X" intersection 4. Preferably, connector 6 will comprise at least one additional protruding node 8 on each side facing into the strap to prevent the intersection 4 from inadvertently slipping during wear. FIG. 5 shows the same threading of straps 1,1' through connector 6, depicting strap 1' not fully inserted into the connector. It is anticipated that connector 6 may utilize different internal and external shapes other than the square/diamond shape depicted herein, for example a connector having an internal threaded "diamond" shape and an external circular configuration, or triangular configurations. There is no limitation of shapes that maybe utilized to form the straps around so long as the connector results in an essentially "X" shaped configuration that is essentially fixed against slippage, but preferably adjustable by the wearer. This provides considerable advantage to a wearer over other prior art devices. For example, the device disclosed in U.S. Pat. No. 2,455,036 to Boylan affirmatively teaches that the ring utilized allows the straps to slip to adjust to movement of the wearer such that there is no fixed stability. On the opposite end of the spectrum, U.S. Pat. No. 3,071,140 to Adler teaches a fixed cross-back design that is not adjustable to the wearer, particularly any body variations that might require one side of the "X" to be of different length from the other. This lack of adjustability would provide discomfort to a wearer who had body variation that resulted, for example, in one shoulder being lower than another, or for wearers who had cup sizes that varied slightly from one another to cause a different weight distribution of the breasts. As proper support is integral to prevent back injury to women of even modest cup size, this flexibility in adjustment in tandem with stable support is critical to the comfort of the wearer and has been heretofore unfound in the art.

What is claimed is:

1. A brassiere comprising:

two breast cups, said cups comprising a perimeter, the perimeter comprising a top portion and a bottom portion, one or more straps, the straps attaching to the cups at the top portion of the perimeter, extending over a wearer's shoulder and across the wearer's back and around the wearer's front, where the strap is attached to the bottom portion of the perimeter of one or both of said breast cups; and a crossover point where one or more straps cross each other on the wearer's back to form an "x" shaped intersection; a rigid connector, said connector comprising multiple slots through which the strap or straps are threaded, the connector being located at the crossover point at the intersection of the straps, said connector stabilizing the position of the straps.

2. The brassiere of claim 1, wherein said connector comprises at least four slots aligned in parallel pairs, the strap or straps are threaded through one slot and its parallel slot on an opposite edge of the connector, and a portion of a strap is threaded through the remaining pair of slots to form a stable "x" shaped configuration in said strap or straps.

3. The brassiere of claim 1, wherein said connector's slots comprise an opening and protuberances, the protuberances jutting into the opening of said slots.

4. A brassiere comprising:

two or more straps made of flexible material;

two breast cups, wherein said breast cups are attached to said straps either integrally or adjacently via means of connecting elements; and a crossover point where said straps cross one another on a wearer's back to form an "X" shaped intersection; a rigid connector, said connector comprising multiple slots through which the strap or straps are threaded, the connector being located at the crossover point at the intersection of the straps, said connector stabilizing the position of the straps.

5. The brassiere of claim 4, wherein the breast cups comprise a perimeter, the perimeter comprising a top portion and a bottom portion, the brassiere comprising additional straps disposed in a pattern essentially comprising two groups of straps, each group being attached to the top portion of each cup.

6. The brassiere of claim 4, wherein said connector comprises two or more pairs of slots aligned in parallel pairs, a strap or a group of straps are threaded through one slot or adjacent slots and through its parallel slot or adjacent slots on an opposite edge of the connector, and a portion of said strap or group of straps is threaded through a remaining pair of slots or group of slots to form a stable x-shaped configuration in said straps or strap groups at the crossover point.

7. The brassiere of claim 4, wherein said connector's slots comprise an opening and slight protuberances, the protuberances jutting into the opening of said slots.

* * * * *